US007831190B2

(12) United States Patent
Yang

(10) Patent No.: US 7,831,190 B2
(45) Date of Patent: Nov. 9, 2010

(54) COVER OPENING AND CLOSING UNIT, IMAGE FORMING APPARATUS HAVING THE SAME, AND METHOD OF REMOVING AND MOUNTING COVER

(75) Inventor: Myung-woo Yang, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 246 days.

(21) Appl. No.: 12/111,225

(22) Filed: Apr. 29, 2008

(65) Prior Publication Data

US 2009/0010677 A1 Jan. 8, 2009

(30) Foreign Application Priority Data

Jul. 4, 2007 (KR) ..... 10-2007-0067080
Feb. 29, 2008 (KR) ..... 10-2008-0019018

(51) Int. Cl.
*G03G 21/12* (2006.01)
*G03G 21/18* (2006.01)

(52) U.S. Cl. ..... 399/360; 399/114

(58) Field of Classification Search ..... 399/110, 399/114, 123, 360
See application file for complete search history.

(56) References Cited

U.S. PATENT DOCUMENTS 6,244,155 B1 * 6/2001 Sparks ..... 86/50
6,374,067 B1 * 4/2002 Park ..... 399/110 X
6,975,830 B2 * 12/2005 Murakami et al. ..... 399/360 X

* cited by examiner

*Primary Examiner*—Sandra L Brase
(74) *Attorney, Agent, or Firm*—Stanzione & Kim, LLP

(57) ABSTRACT

A cover opening and closing unit for an image forming apparatus, includes a cover removably mounted to a main body of the image forming apparatus mounting therein a developer cartridge, a developing unit, a transferring unit and a waste-developer receptacle, and a locking device fixing the cover to the main body of image forming apparatus. The locking device is released from the main body only after the waste-developer receptacle is removed from the main body.

25 Claims, 12 Drawing Sheets

COVER OPENING AND CLOSING UNIT, IMAGE FORMING APPARATUS HAVING THE SAME, AND METHOD OF REMOVING AND MOUNTING COVER

CROSS-REFERENCE TO RELATED APPLICATIONS

This application claims priority under 35 U.S.C. §119(a) from Korean Patent Application No. 10-2007-0067080, filed on Jul. 4, 2007, and Korean Patent Application No. 10-2008-0019018, filed on Feb. 29, 2008, in the Korean Intellectual Property Office, the contents of which are incorporated herein by reference in their entirety.

BACKGROUND OF THE INVENTION

1. Field of the Invention

The present general inventive concept relates to an image forming apparatus. More particularly, the present general inventive concept relates to a cover opening and closing unit removably mounted to a main body of an image forming apparatus to cover a developing unit and a transferring unit, an image forming apparatus having the same, and a method of removing and mounting a cover.

2. Description of the Related Art

Generally, image forming apparatuses include consumable parts, such as a developer cartridge, a developing unit including photoconductive mediums, a transferring unit, and the likes. Such consumable parts having predetermined lifespan are removably structured for replacement with new ones when the lifespan is over.

Frequently replaced parts, such as the developer cartridge, are structured for a user's convenient access since they are generally replaced and maintained by the user. However, some other parts, such as the developing unit and the transferring unit, need a skilled workman or an expert engineer for replacement. If such parts are open to every person's access, the image forming apparatus may malfunction due to an unskilled user's mistake or wrong operation in a removal and mounting of the parts. Therefore, general developing units and transferring units are equipped with a dedicated cover unit for protection from undesired access.

A color image forming apparatus includes developer cartridges separately for respective colors. A high-speed color image forming apparatus, especially, may include separate developing units for respective colors. The respective developing units include a drain for discharging waste developer. The discharged waste developer is collected to a waste-developer receptacle removably connected to a lower end of the respective developing units.

In general, the waste-developer receptacle is removed before performing maintenance work, such as repair and replacement of the developing unit and the transferring unit, and remounted after the maintenance work are completed.

However, in case that the user breaks the correct order by mistake or forgets to remount the waste-developer receptacle after the maintenance work, the inside of image forming apparatus may be contaminated by the waste developer leaking during operation of the image forming apparatus. Especially, furthermore, a conventional cover unit for merely covering the developing unit and the transferring unit can be locked regardless of presence of the waste-developer receptacle. In other words, even with the waste-developer receptacle unmounted after the maintenance work, the user may lock the cover unit.

Meanwhile, a connection structure between the drain of the developing unit and an inlet of the waste-developer receptacle is sealed by sealing members superposed on each other by predetermined thickness, so as to prevent leakage of the waste-developer. When the waste-developer receptacle is separated from the developing unit, the waste-developer accumulated in the sealing members may scatter about, thereby contaminating the inside of image forming apparatus.

SUMMARY OF THE INVENTION

The present general inventive concept provides a cover opening and closing unit improved to help a user observe correct orders to remove and mount a cover during maintenance, an image forming apparatus having the same, and a method of removing and mounting the cover.

The present general inventive concept also provides an improved cover opening and closing unit capable of simplifying a connection structure between a developing unit and a waste-developer receptacle, an image forming apparatus having the same, and a method of removing and mounting a cover.

Additional aspects and utilities of the present general inventive concept will be set forth in part in the description which follows and, in part, will be obvious from the description, or may be learned by practice of the general inventive concept.

The foregoing and/or other aspects and utilities of the present general inventive concept are also achieved by providing a cover opening and closing unit for an image forming apparatus, including a cover removably mounted to a main body of the image forming apparatus, the main body mounting a developer cartridge, a developing unit, a transferring unit and a waste-developer receptacle therein, and a locking device to fix the cover to the main body of image forming apparatus, wherein the locking device is released from the main body only after the waste-developer receptacle is removed from the main body.

The cover is formed to shield the developing unit and the transferring unit. The cover is mounted to the main body of image forming apparatus so that the developer cartridge and the waste-developer receptacle are exposed.

The locking device includes at least one rotary handle, a locking member to protrude and withdraw in association with a rotation of the rotary handle, a cam member rotated in association with rotation of the rotary handle to thereby protrude and withdraw the locking member, a restriction unit to reciprocate between a first position to hinder rotation of the cam member and a second position released from the cam member, and a sensing lever displaced according to whether the waste-developer receptacle is mounted, and thereby to move the restriction unit to the first position when the waste-developer receptacle is removed.

The locking member may be resiliently biased by a first resilient member disposed between the cam member and the locking member.

The cam member may include a first cam profile to protrude and withdraw the locking member, and a locking recess.

The restriction unit may include a restriction lever to reciprocate between the first and second positions in association with the displacement of the sensing lever, and a restriction pin mounted to one end of the restriction lever nearer to the cam member and hooked in a fixing recess formed on the cam member when the restriction lever is in the first position.

The sensing lever may include a sensing protrusion formed at one end thereof and interfered with an upper end of the waste-developer receptacle. The sensing protrusion may have slant surfaces in directions to both mount and remove the waste-developer receptacle.

The sensing lever and the restriction lever may be disposed perpendicularly to each other. The restriction lever may be mounted horizontally while the restriction lever vertically.

The cover opening and closing unit may further include an intermediate member that reciprocates the restriction lever transversely according to up and down movement of the sensing lever. The intermediate member may include a first rack formed on the other end of the sensing lever, a second rack formed on the other end of the restriction lever, and pinions geared with the first and the second racks respectively.

The cover opening and closing unit may further include a second resilient member to resiliently bias the restriction lever to the second position, a third resilient member to resiliently bias the restriction pin outward with respect to the restriction lever, and a fourth resilient member to resiliently bias the sensing lever outward with respect to the cover.

The waste-developer receptacle may include a guide part disposed to face the sensing lever and having a guide surface. The waste-developer receptacle may include a waste-developer inlet slantly formed and engaged with a drain to discharge waste developer from the developing unit. Here, the waste-developer inlet may have a higher end in a direction to remove the waste-developer receptacle and a lower end in a direction to mount the waste-developer receptacle.

The foregoing and/or other aspects and utilities of the present general inventive concept are also achieved by providing a cover opening and closing unit for an image forming apparatus, including a cover removably mounted to a main body of the image forming apparatus, the main body mounting a developer cartridge, a developing unit, a transferring unit and a waste-developer receptacle therein, a locking device to fix the cover to the main body of image forming apparatus, wherein the locking device is released from the main body only after the waste-developer receptacle is removed from the main body, and comprises first and second rotary handles to rotate between a locked position and a released position, first and second cam members to rotate in association with rotation of the first and second rotary handles, respectively, first and second locking members to protrude and withdraw respectively by the first and second rotary handles, first and second resilient members to resiliently bias the first and second locking members, respectively, first and second restriction units to reciprocate between a first position to hinder rotation of the first and second cam members and a second position released from the cam members, and a sensing lever displaced according to whether the waste-developer receptacle is mounted, and thereby to move the restriction unit to the first position when the waste-developer receptacle is removed.

The first cam member may include a first cam profile to protrude and withdraw the first locking member; and a first gear part geared with a reset member to reset an initial position of the transferring unit.

The reset member may include a second gear part geared with the first gear part, a second cam profile interfered with the first restriction unit, and a first fixing recess to hook the first restriction unit being in the first position. The waste-developer receptacle may include a guide part disposed to face the sensing lever and having a guide surface.

The second cam member may include a third cam profile to protrude and withdraw the second locking member, a fourth cam profile interfered with the second restriction unit, and a second fixing recess to hook the second restriction unit being in the first position.

The first and second restriction units respectively may include first and second restriction levers to reciprocate between the first position and the second position in association with the displacement of the sensing lever, and first and second restriction pins formed at one end of the first and second restriction levers respectively, the one end nearer to the first and second cam members, and hooked in the first and second fixing recesses when the restriction levers are in the first position.

The sensing lever may include a sensing protrusion formed at one end thereof, interfered with the upper end of waste-developer receptacle, and having slant surfaces in directions to both mount and remove the waste-developer receptacle.

The first and second levers may be horizontally mounted while the sensing lever may be vertically mounted.

The cover opening and closing unit may further include first and second intermediate members that transversely reciprocate the first and second restriction levers, respectively, according to up and down movement of the sensing lever. The first and second intermediate members respectively may include first and second racks formed on both sides of the other end of the sensing lever, third and fourth racks formed on the other ends of the first and second restriction levers, a first pinion geared with the first and third racks, and a second pinion geared with the second and fourth racks.

The first and second restriction levers and the sensing lever may include at least one sliding slot so as to be slidably connected to the cover by fixing pins and washers penetrating the sliding slot.

The cover opening and closing unit may further include third and fourth resilient members to resiliently bias the first and second restriction levers respectively to the second position, fifth and sixth resilient members to resiliently bias the first and second restriction pins outward with respect to the first and second restriction levers, respectively, and a seventh resilient member to resiliently bias the sensing lever outward with respect to the cover.

The foregoing and/or other aspects and utilities of the present general inventive concept are also achieved by providing an image forming apparatus including a main body in which a developing unit, a transferring unit, and a waste-developer receptacle are mounted, and a cover opening and closing unit removably mounted to the main body to shield the developing unit and the transferring unit, including a cover removably mounted to a main body of the image forming apparatus, the main body mounting a developer cartridge, a developing unit, a transferring unit and a waste-developer receptacle therein, a locking device to fix the cover to the main body of image forming apparatus, wherein the locking device is released from the main body only after the waste-developer receptacle is removed from the main body, and comprises first and second rotary handles to rotate between a locked position and a released position, first and second cam members to rotate in association with rotation of the first and second rotary handles, respectively, first and second locking members to protrude and withdraw respectively by the first and second rotary handles, first and second resilient members to resiliently bias the first and second locking members, respectively, first and second restriction units to reciprocate between a first position to hinder rotation of the first and second cam members and a second position released from the cam members, and a sensing lever displaced according to whether the waste-developer receptacle is mounted, and thereby to move the restriction unit to the first position when the waste-developer receptacle is removed.

The foregoing and/or other aspects and utilities of the present general inventive concept are also achieved by providing a method of removing a cover of an image forming apparatus, including removing a waste-developer receptacle, moving a sensing lever down by interference with the waste-developer receptacle, moving first and second restriction levers by downward movement of the sensing lever to separate from the first and second cam members, and releasing the cover by rotating first and second rotary handles.

The foregoing and/or other aspects and utilities of the present general inventive concept are also achieved by providing a method of mounting a cover of an image forming apparatus including mounting a developing unit and a transferring unit to a main body of the image forming apparatus, mounting a waste-developer receptacle, moving first and second restriction levers by upward movement of a sensing lever to release interference of first and second cam members, locking the cover by rotating first and second rotary handles, and restriction pins formed at one end of the first and second restriction levers to hinder rotation of the first and second cam members and further to hinder the first and second rotary handles from rotating to a released position.

The foregoing and/or other aspects and utilities of the present general inventive concept are also achieved by providing a method of mounting a cover of an image forming apparatus, including mounting a developing unit and a transferring unit to a main body of the image forming apparatus, mounting the cover so that the developing unit and the transferring unit are shielded, locking the cover by rotating first and second rotary handles, and mounting a waste-developer receptacle.

The foregoing and/or other aspects and utilities of the present general inventive concept are also achieved by providing a removable cover of an image forming apparatus that mounts therein a developer cartridge, a developing unit, a transferring unit and a waste-developer receptacle therein, the removable cover including a cover plate having a plurality of locking members to lock the cover plate to the image forming apparatus in a position to shield the developing unit and the transferring unit from access while allowing access to the developer cartridge and the waste-developer, a plurality of rotary handles to protrude and withdraw the plurality of locking members to lock the cover plate, and a sensing lever mounted on the cover plate to prevent the locking of the cover plate when the waste-receptacle is not mounted.

The removable cover may further include a plurality of cam members to rotate according to a rotation of a corresponding one of the plurality of rotary handles to protrude and withdraw the locking member, and a plurality of restriction units to reciprocate between a first position to prevent rotation of a corresponding one of the plurality of cam members and a second position to release the corresponding one of the plurality of cam members, wherein the sensing lever moves the restriction units to the first position when the waste-developer receptacle is removed.

The removable cover may not be removed without first removing the waste-developer receptacle.

The foregoing and/or other aspects and utilities of the present general inventive concept are also achieved by providing a removable cover of an image forming apparatus that mounts a plurality of image forming units in a main body thereof, the removable cover including a removable cover plate to shield a predetermined number of the image forming units in the main body while allowing access to another predetermined number of image forming units in the main body, a plurality of locking members to lock the removable cover plate to the image forming apparatus, a plurality of rotary handles to move the locking members to one of a lock position and an unlock position, and a sensing lever to prevent the locking of the removable cover plate according to an absence of one of the another predetermined number of image forming units.

The another predetermined number of image forming units may include at least one of a developer cartridge and a waste-developer receptacle.

The removable cover plate may not be removed without first removing the one of the another predetermined number of image forming units.

BRIEF DESCRIPTION OF THE DRAWINGS

These and/or other aspects and utilities of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
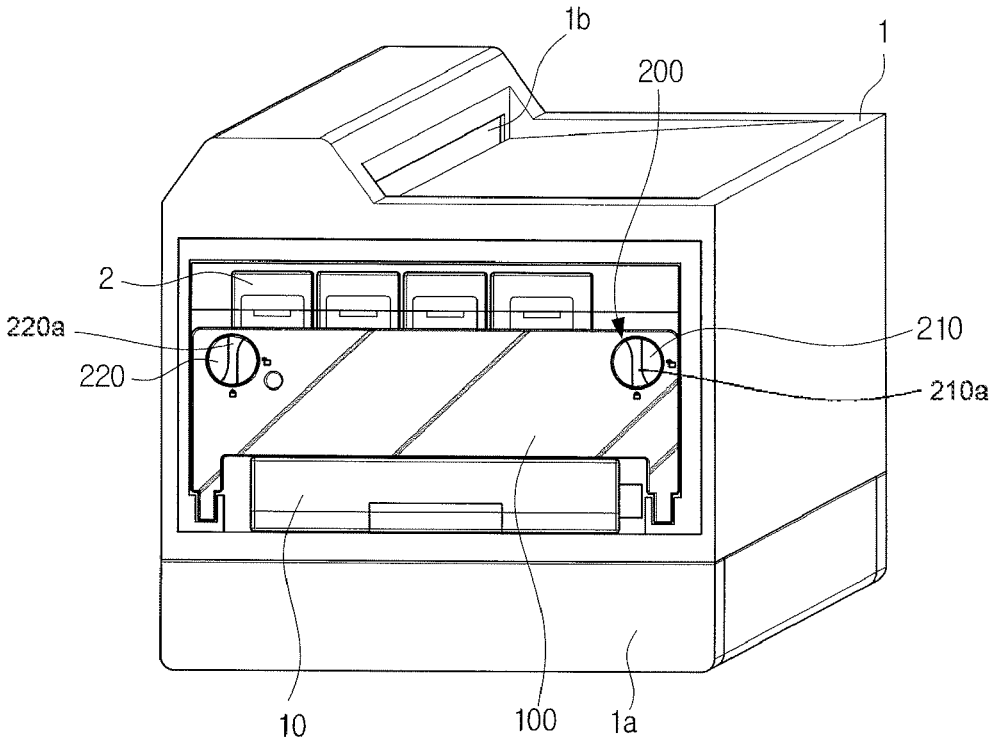
FIG. 1 is a perspective view illustrating a cover as mounted to an image forming apparatus according to an embodiment of the present general inventive concept.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

The matters defined in the description, such as a detailed construction and elements, are nothing but the ones provided to assist in a comprehensive understanding of the general inventive concept. Thus, it is apparent that the present general inventive concept can be carried out without those defined matters.

Figure 2:
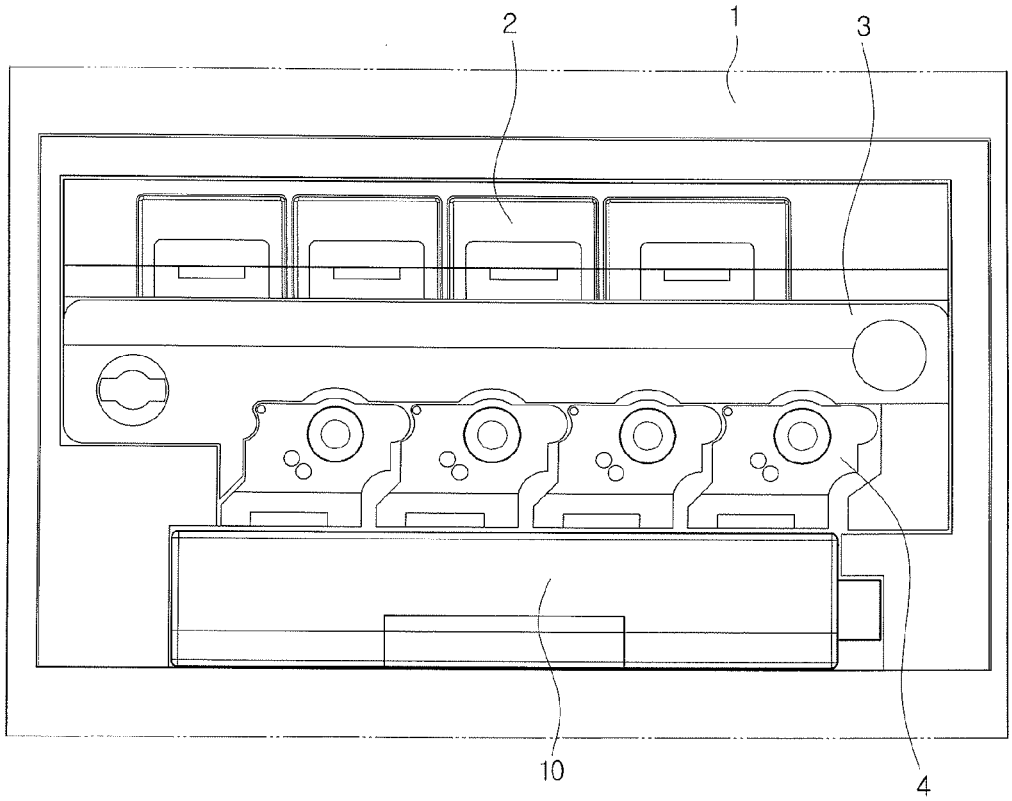
FIG. 2 is a perspective view illustrating the image forming apparatus of FIG. 1 with the cover removed.

Referring to FIGS. 1 and 2, a main body 1 of an image forming apparatus may include therein a developer cartridge 2, a transferring unit 3, a developing unit 4, and a waste-developer receptacle 10, which can all be removably mounted.

A paper feed unit 1*a* to store a plurality of paper sheets may be formed below the main body 1. Accordingly, a paper sheet is picked up from the paper feed unit 1*a*, and passed through the transferring unit 3 and the developing unit 4 to have a predetermined image formed thereon, and discharged outside the image forming apparatus through a discharge unit 1*b*.

The developer cartridge 2, the transfer unit 3 and the developing unit 4 each have a predetermined lifespan. Specifically, the developer cartridge 2 has to be replaced if all the developer held therein is used up, and the developer unit 4 has to be replaced if the light exposing surface thereof has a degrading light reception.

The transfer unit 3 and the developing unit 4 have a relatively longer lifespan than the developer cartridge 2 or the waste-developer receptacle 10. Additionally, the transfer unit 3 and the developing unit 4 are desirably blocked from the outside environment, such as dust or contaminant, since these two units 3 and 4 are placed in position in which the image is transferred onto the paper sheet passed therebetween.

While the developer cartridge 2 and the waste-developer receptacle 10 are mounted without a special cover unit for easy access by a user as illustrated in FIG. 1, the transferring unit 3 and the developing unit 4 are mounted to be shielded by a cover 100. This is intended not only to prevent entry of foreign substances, such as dust, into the transferring unit 3 and the developing unit 4, but also to prevent easy access to the transferring unit 3 and the developing unit 4 by general users unfamiliar with the image forming apparatus so that parts of the image forming apparatus are not broken by mistake of the users.

A cover opening and closing unit according to an exemplary embodiment of the present general inventive concept may include the cover 100 and a locking device 200. The locking device 200 is structured to be released only when the waste-developer receptacle 10 is removed.

The locking device 200 to fix the cover 100 to the main body 1 of the image forming apparatus, may include first and second rotary handles 210 and 220, first and second cam members 211 and 221, first and second locking members 212 and 222, first and second resilient members 213 and 223, first and second restriction units 230 and 240, and a sensing lever 250.

The first and second rotary handles 210 and 220 can be formed to rotatingly move between a locked position and a released position of the locking device 200 and may have a circular form as illustrated in FIG. 1. The first and second rotary handles 210 and 220 can be provided with grip parts 210*a* and 220*a*, respectively, for the user to grip.

The first cam member 211 is rotated in association with the first rotary handle 210. The first cam member 211 may include a first cam profile 211*a* that protrudes and withdraws the first locking member 212, and a first gear part 211*b* geared with a reset member 217 to reset an initial position of the transferring unit 3 (see FIGS. 5A-5B).

The first locking member 212 is biased resiliently toward an inside of the cover 100 by the first resilient member 213. The first locking member 212 is disposed inside the cover 100 when not engaged with the first cam profile 211*a*, but protrudes out of the cover 100 upon contact with the first cam profile 211*a*. A locking recess (not illustrated) is formed on the main body 1 of the image forming apparatus at a position facing the first locking member 212, in order to fix the cover 100 in the locked position by the first locking member 212 inserted therein.

The reset member 217 may include a second gear part 214 geared with the first gear part 211*b*, a second cam profile 215 contacted with the first restriction unit 230, and a first fixing recess 216 hooked by the first restriction unit 230 when the waste-developer receptacle is removed. The reset member 217 just to reset the initial position of an intermediate transfer belt of the transferring unit 3 will not be described in detail since it is known in the art.

The second cam member 221 may include a third cam profile 221*a* to protrude and withdraw the second locking member 222, a fourth cam profile 221*b* contacted with the second restriction unit 240, and a second fixing recess 221*c* hooked by the second restriction unit 240.

The second locking member 222 is biased resiliently toward the inside of the cover 100 by the second resilient member 223. The second locking member 222 is disposed inside the cover 100 when not engaged with the third cam profile 221*a*, but protrudes out of the cover 100 upon contact with the third cam profile 221*a*. Another locking recess (not illustrated) is formed on the main body 1 at a position facing the second locking member 222, in order to fix the cover 100 in the locked position by the second locking member 222 inserted therein.

Figure 3:
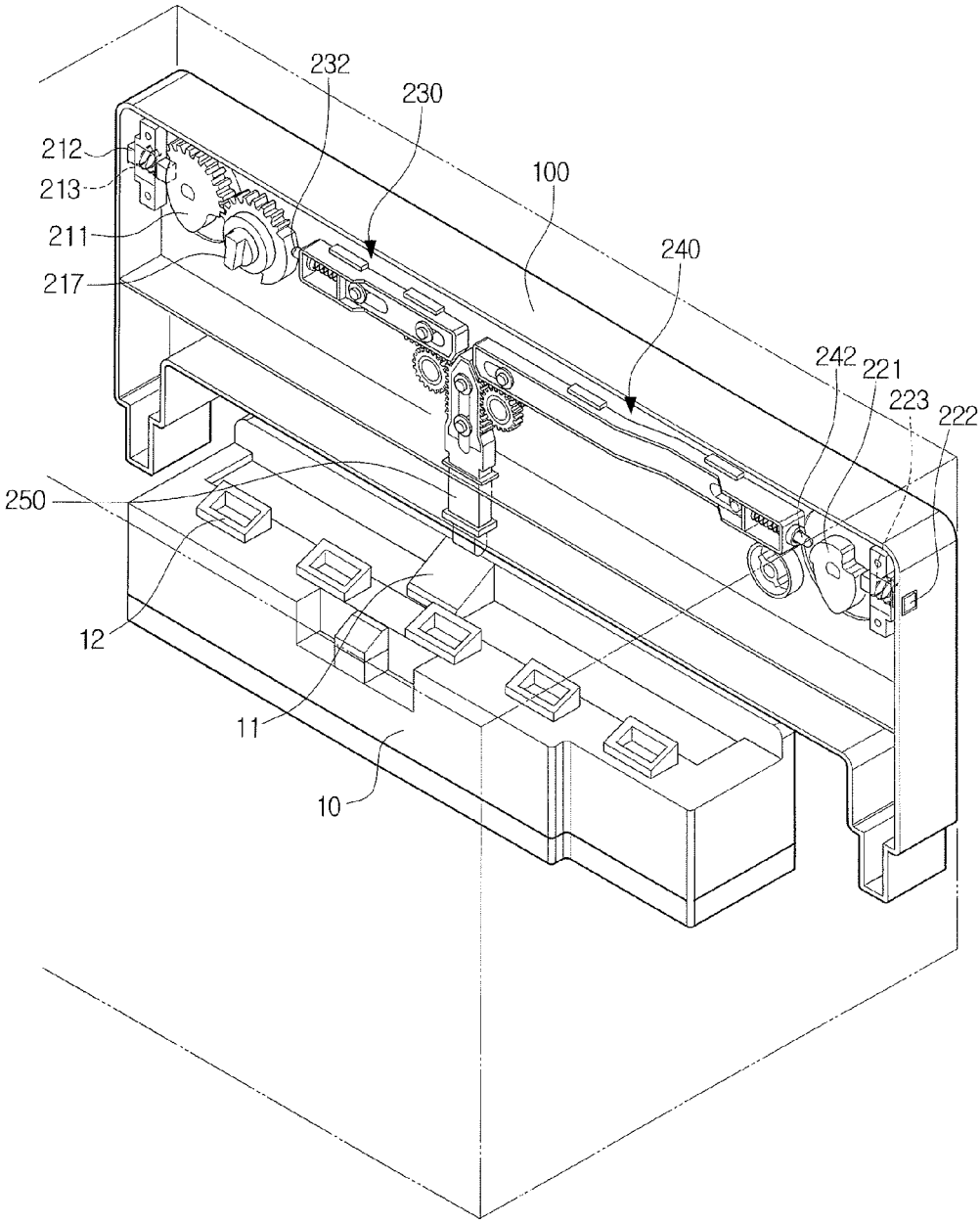
FIG. 3 is a perspective view illustrating the cover mounted to a main body of the image forming apparatus by a cover opening and closing unit according to an embodiment of the present general inventive concept, as seen from the inside of the image forming apparatus.

As illustrated in FIG. 3, the first and second restriction units 230 and 240 are movable transversely in association with an up and down movement of the sensing lever 250. The structure of the first and second restriction units 230 and 240 will be described hereinafter in detail with reference to FIGS. 5A-5B.

The sensing lever 250 is mounted vertically to the cover 100 and is positioned according to whether the waste-developer receptacle 10 is mounted. More specifically, when the waste-developer receptacle 10 is mounted, the sensing lever 250 moves up by interference with an upper end of the waste-developer receptacle 10. Here, the first and second restriction units 230 and 240 move in association with the upward movement of the sensing lever 250 to a first position to hinder a rotation of the first and second cam members 211 and 221. The first and second restriction units 230 and 240 in the first position interfere with the first and second cam members 211 and 221, thereby hindering rotation of the first and second rotary handles 210 and 220 to the released position. Accordingly, the user cannot open the cover 100 before removing the waste-developer receptacle 10.

Figure 4A:
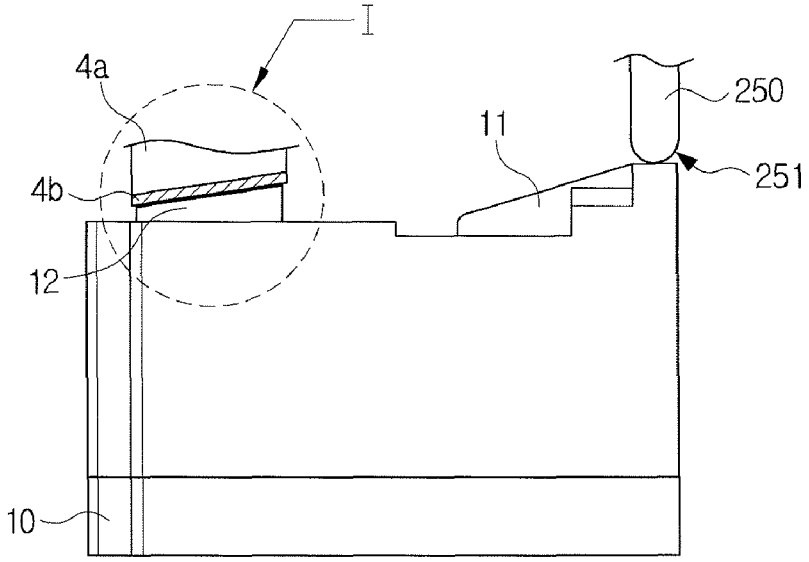
FIG. 4A is a side view of main parts illustrated in FIG. 3.

A sensing protrusion 251 is formed at an end of the sensing lever 250 to interfere with the upper end of waste-developer receptacle 10, as illustrated in FIG. 4A. The sensing protrusion 251 is rounded or chamfered off so as to be slant against both mounting and removing directions of the waste-developer receptacle 10. The other end of the sensing protrusion 251 is provided with first and second racks 252*a* and 252*b* to move the first and second restriction unit 230 and 240.

Figure 4B:
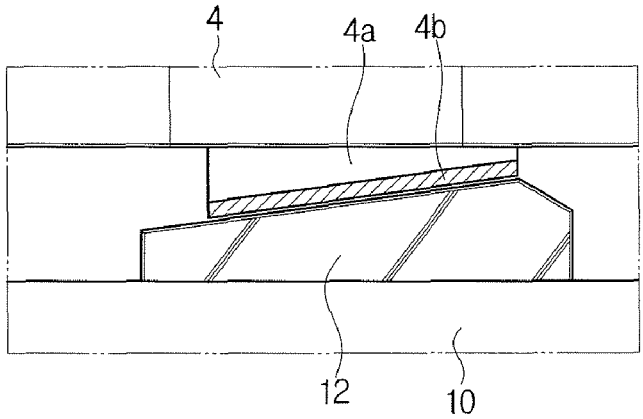
FIG. 4B is an enlarged perspective view illustrating an area 'I' of FIG. 4A.

According to an exemplary embodiment of the present general inventive concept, the waste-developer receptacle 10 may have a guide slope 11 facing the sensing protrusion 251 to help the sensing protrusion 251 smoothly slide up. In addition, a waste-developer inlet 12 engaged with a drain 4*a* to discharge waste developer from the developing unit 4 and a sealing member 4*b* preferably has a slant form. More specifically, as illustrated in FIGS. 4A and 4B, the waste-developer inlet 12 has a higher end in a direction to remove the waste-developer receptacle 10 and a lower end in a direction to mount the waste-developer receptacle 10. The drain 4*a* and the sealing member 4*b* are shaped corresponding to the slant end of the waste-developer inlet 12.

According to the above structure, opening of the cover 100 during maintenance work of the transferring unit 3 and the developing unit 4 is enabled only after the waste-developer receptacle 10 is removed. As a result, a connection structure between the drain 4*a* of the developing unit 4 and the waste-developer inlet 12 can be simplified. Also, leakage of waste developer due to worn or damaged sealing member 4*b* can be prevented because the sealing member 4*b* interposed between the drain 4*a* and the waste-developer inlet 12 will not be folded or thereby damaged during removal and mounting of the waste-developer inlet 12 and the waste-developer receptacle 10.

According to an exemplary embodiment of the present general inventive concept, and referring to FIGS. 9 to 12, a movable handle 15 may be formed on the waste-developer receptacle 10 in a position to face the sensing protrusion 251. Specifically, the movable handle 15 may be engaged with approximately the center portion of the waste-developer receptacle 10 by a hinge unit 16 to fold and unfold by a hinging movement. The movable handle 15 is interfered with the sensing protrusion 251 to restrict the sensing lever 250 from moving downward, when the waste-developer receptacle 10 is mounted in the image forming apparatus. If the waste-developer receptacle 10 is removed from the image forming apparatus the movable handle 15 is used for a user to grab and carry the waste-developer receptacle 10.

Figure 5A:
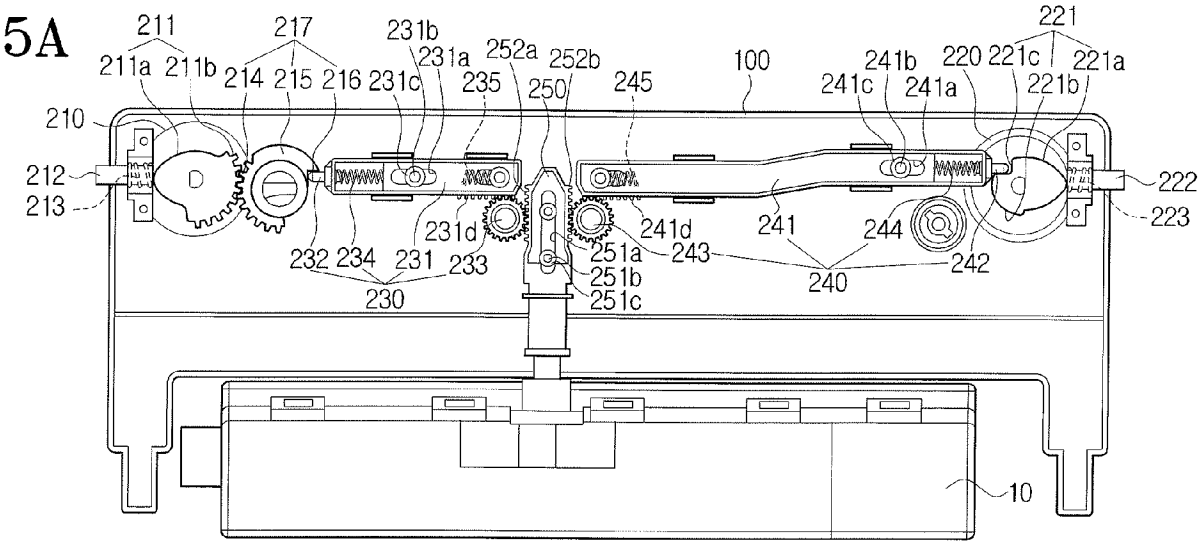
FIGS. 5A and 5B illustrate the cover opening and closing unit according to the embodiment of the present general inventive concept, being in a locked state.

Referring to FIG. 5A, the sensing lever 250 may include a sliding slot 251*a* and is fixed to the cover 100 by one or more lever fixing pins 251*b* and lever washers 251*c* penetrating the sliding slot 251*a*. Therefore, upon removal of the waste-developer receptacle 10, the sensing lever 250 is protruded in an arrowed direction A of FIG. 6A in association with the operation of the first and second restriction units 230 and 240, thereby moving the first and second restriction units 230 and 240 in arrowed directions B1 and B2 respectively.

Hereinafter, the structure of the first and second restriction units 230 and 240 will be described in further detail with reference to FIGS. 5A and 5B.

The first restriction unit 230 includes a first restriction lever 231 and a first restriction pin 232.

As illustrated in FIG. 5A, the first restriction lever 231 is horizontally mounted to the cover 100 to reciprocate between a first position o hinder rotation of the first cam member 211 and a second position separated from the first cam member 211.

Here, the first restriction lever 231 includes at least one first sliding slot 231*a* so as to be fixed to the cover 100 by a first fixing pin 231*b* and a first washer 231*c* penetrating the first sliding slot 231*a*. A third resilient member 235 is interposed between the cover 100 and the first restriction lever 231 to resiliently bias the first restriction lever 231 toward the second position. The first restriction lever 231 includes a third rack 231*d* geared with a first pinion 233 rotated according to the up and down movement of the sensing lever 250.

The first restriction pin 232 is mounted at one end of the first restriction lever 231 to be protruded out and withdrawn. Being disposed to face the reset member 217 as illustrated in FIG. 5A, the first restriction pin 232 hooks in the first fixing recess 216 when the first restriction lever 231 is in the first position and releases from the first fixing recess 216 when in the second position. According to an exemplary embodiment of the present general inventive concept, the first restriction pin 232 is biased outward with respect to the first restriction lever 231 by a fifth resilient member 234.

The second restriction unit 240 may include a second restriction lever 241 and a second restriction pin 242.

The second restriction lever 241 is mounted horizontally to the cover 100 to reciprocate between a first position to hinder rotation of the second cam member 221 and a second position separated from the second cam member 221, as illustrated in FIG. 5A.

The second restriction lever 241 may include at least one second sliding slot 241*a* so as to be fixed to the cover 100 by a second fixing pin 241*b* and a second washer 241*c* to penetrate the second sliding slot 241*a*. A fourth resilient member 245 is interposed between the cover 100 and the second restriction lever 241 to resiliently bias the second restriction lever 241 toward the second position. The second restriction lever 241 includes a fourth rack 241*d* geared with a second pinion 243 to rotate according to the up and down movement of the sensing lever 250.

The second restriction pin 242 is mounted at one end of the second restriction lever 241 to be protruded out and withdrawn. As illustrated in FIG. 5A, according to an exemplary embodiment, the second restriction pin 242 is disposed to face the second cam member 221 to be hooked in the second fixing recess 221*c* when the second restriction lever 241 is in the first position and released from the second fixing recess 221*c* when in the second position. Also, the second restriction pin 242 is biased outward with respect to the second restriction lever 241 by a sixth resilient member 244.

Hereinafter, the operation of the cover opening and closing unit of the image forming apparatus according to the embodiment of the present general inventive concept will be described in detail with reference to FIG. 5A through FIG. 8B.

Figure 5B:
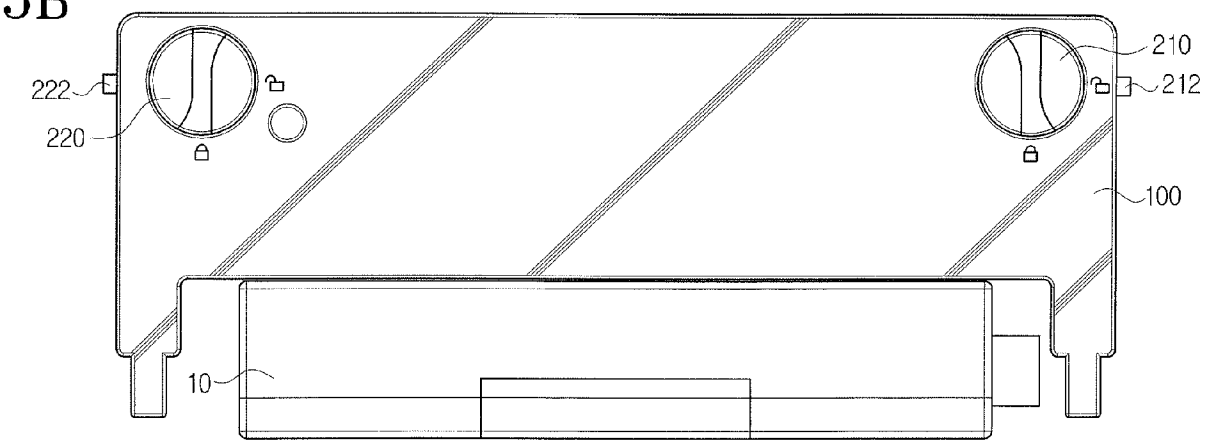

FIGS. 5A and 5B illustrate the cover 100 as locked in the main body 1 of image forming apparatus. The waste-developer cartridge 2, the transferring unit 3, the developing unit 4, and the waste-developer receptacle 10 are all mounted to the main body 1.

In the locked state, the first and second restriction pins 232 and 242 hinder rotation of the first and second cam members 211 and 221 so that the first and second rotary handles 210 and 220 cannot rotate to the released position. According to this, a user is not able to release the cover 100 without removing the waste-developer receptacle 10.

Figure 6A:
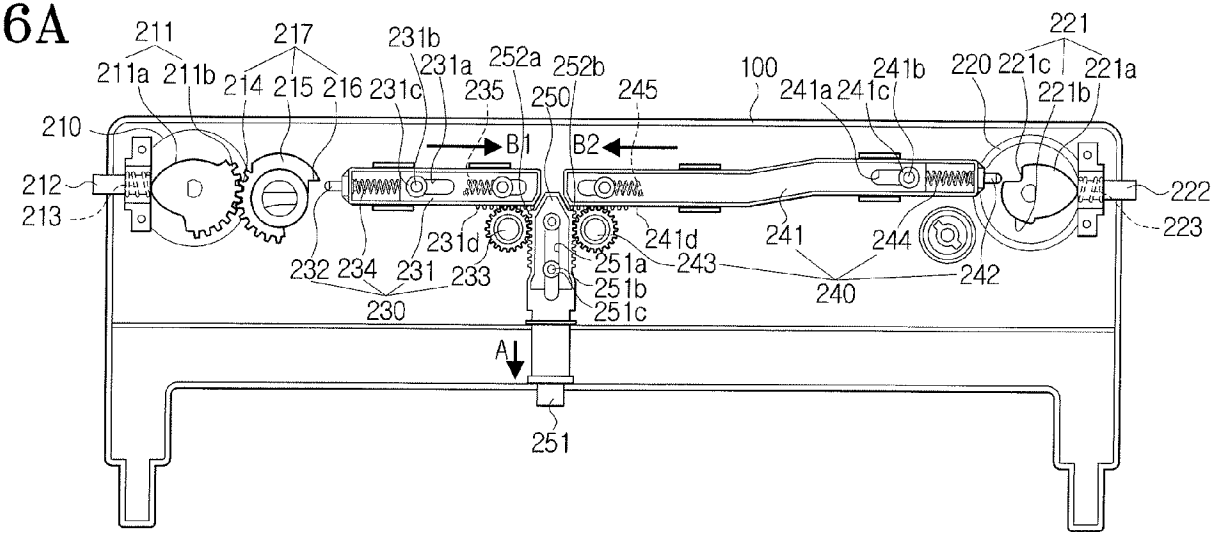
FIGS. 6A and 6B illustrate the cover opening and closing unit in the locked state with a waste-developer receptacle removed.
Figure 6B:
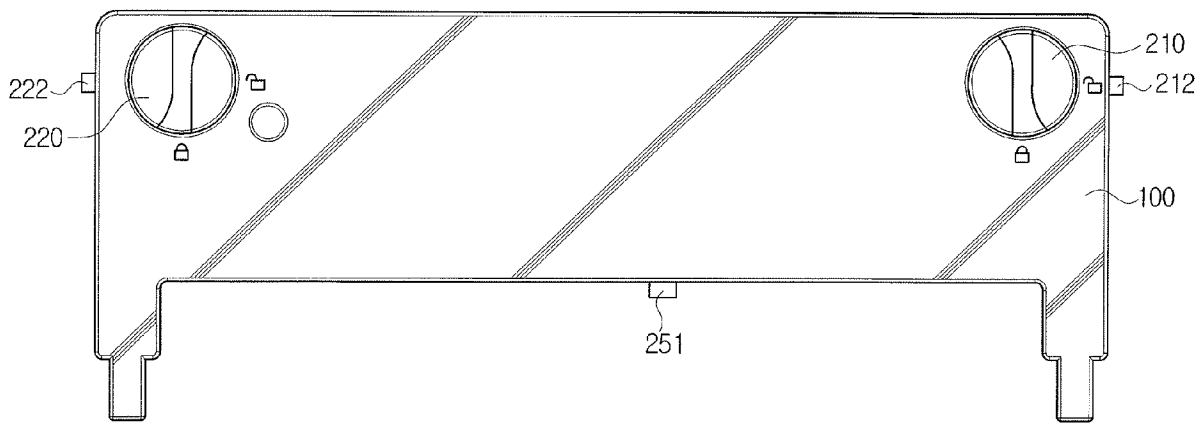

When the user removes the waste-developer receptacle 10, as illustrated in FIGS. 6A and 6B, the sensing lever 250 interfered with the upper end of waste-developer receptacle 10 moves in the arrowed direction A. Here, although being mounted to move in the arrowed directions B1 and B2 respectively by the third and fourth resilient members 235 and 245, the first and second restriction levers 231 and 241 cannot move in the directions B1 and B2 with the waste-developer receptacle 10 mounted because the end of sensing lever 250 is interfered with the upper end of waste-developer receptacle 10. When the waste-developer receptacle 10 is removed, however, the first and second restriction levers 231 and 241 are released and moved in the directions B1 and B2, thereby moving down the sensing lever 250 in the direction A. According to this, the first and second restriction units 230 and 240 are moved to the second position where the first and second cam members 211 and 221 are released.

Thus, since the first and second restriction pins 232 and 242 are released from the first and second fixing recesses 216 and

Figure 7A:
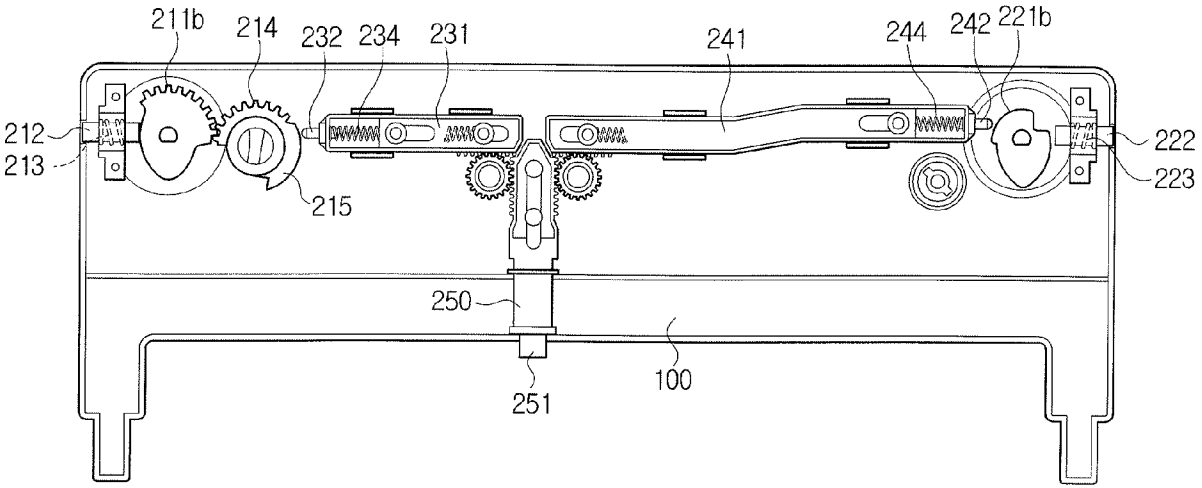
FIGS. 7A and 7B illustrate the cover opening and closing unit in a released state.
Figure 7B:
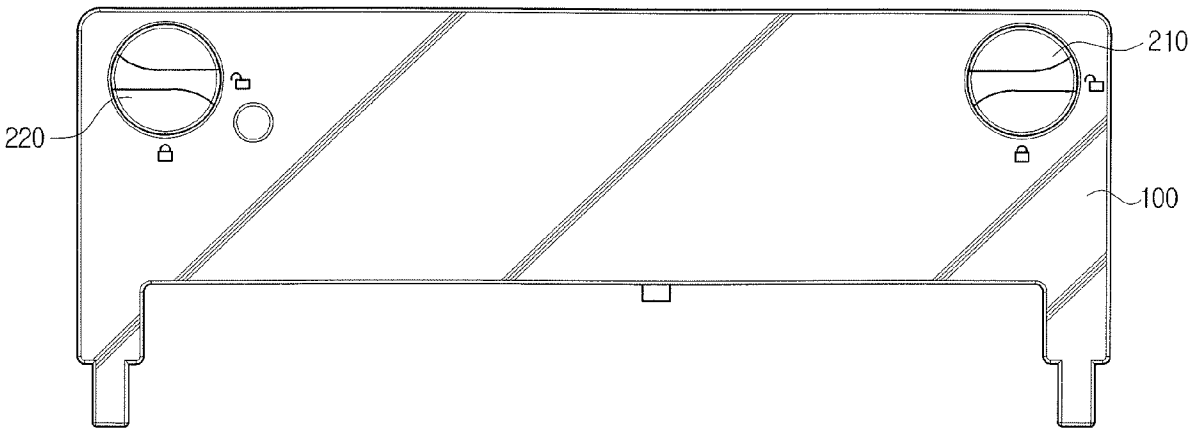
Figure 8A:
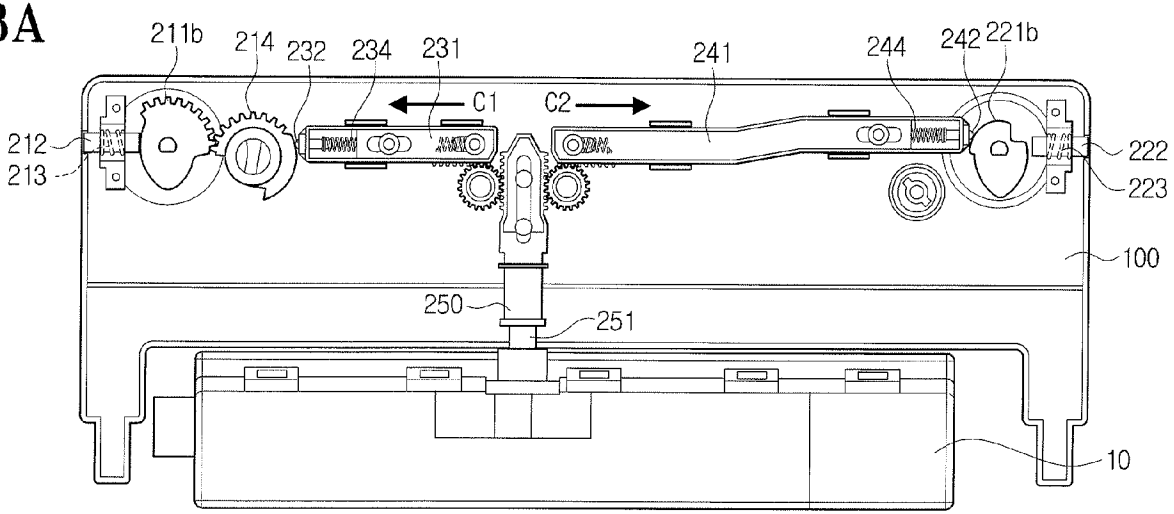
FIGS. 8A and 8B illustrate the cover opening and closing unit in the released state with the waste-developer receptacle mounted.
Figure 8B:
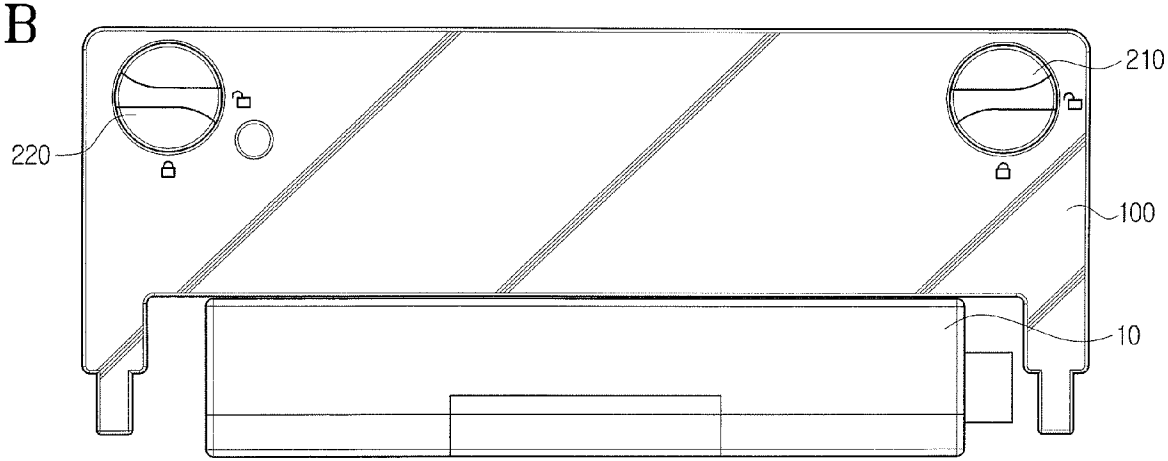
Figure 9:
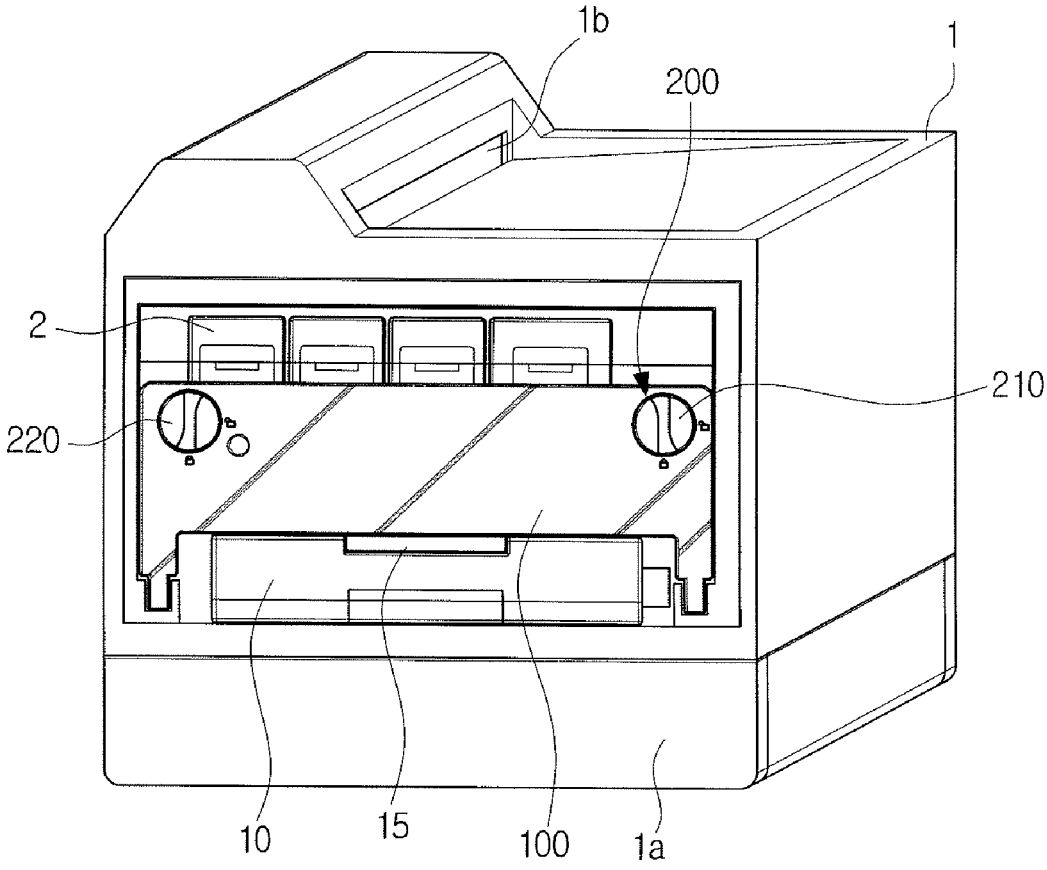
FIG. 9 is a perspective view illustrating an image forming apparatus housing therein a waste-developer receptacle according to an exemplary embodiment of the present general inventive concept, on which a cover is mounted.
Figure 10:
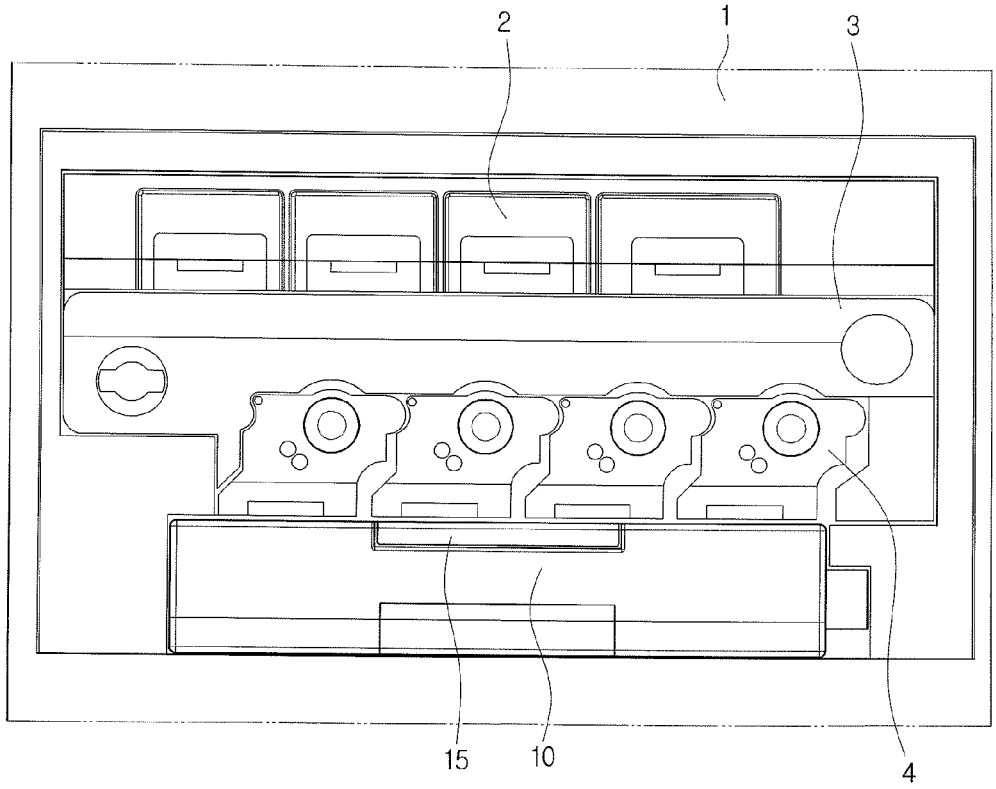
FIG. 10 is a perspective view illustrating the image forming apparatus of FIG. 9 from which the cover is removed.
Figure 11:
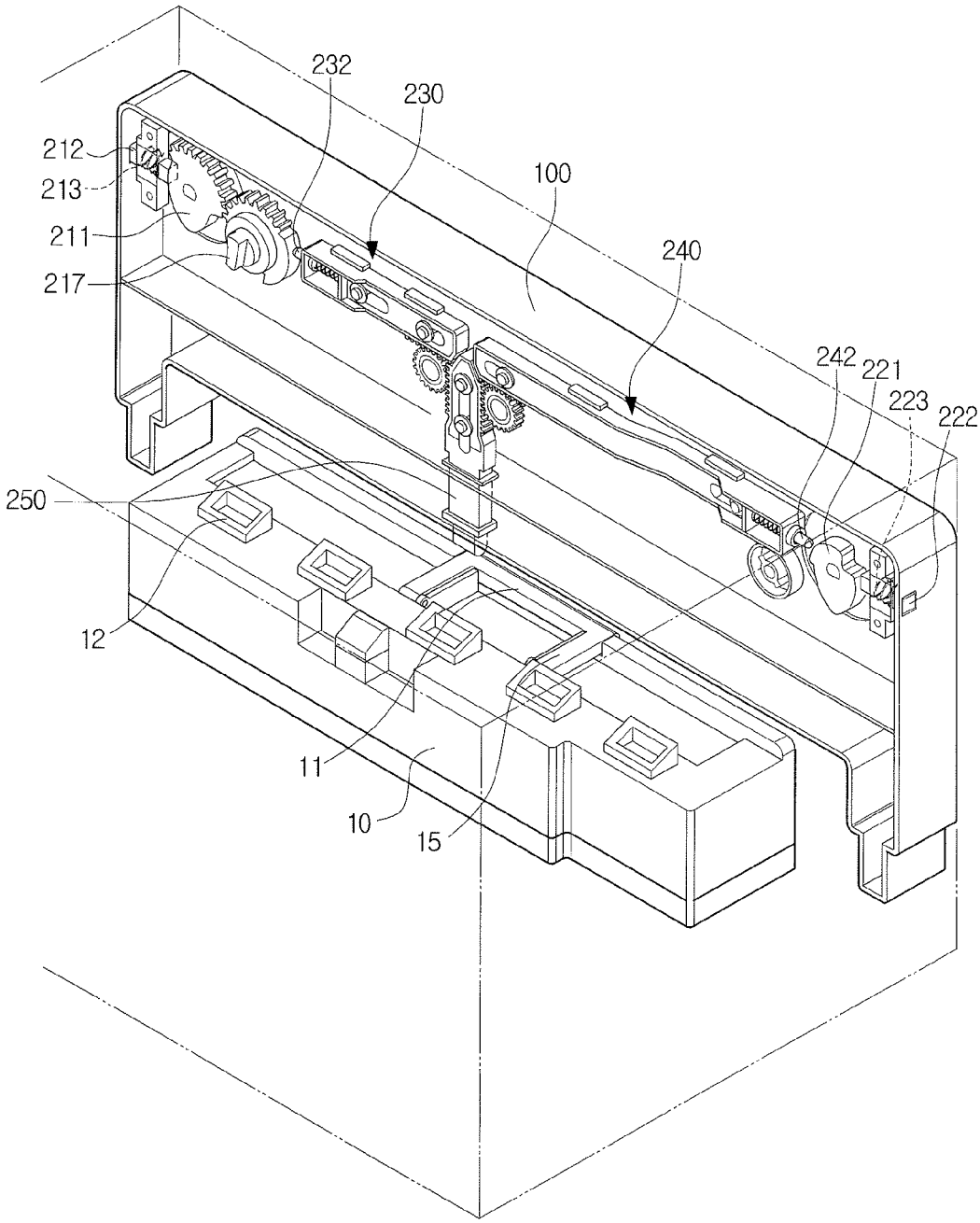
FIG. 11 is a perspective view illustrating an image forming apparatus housing therein a waste-developer receptacle according to an exemplary embodiment of the present general inventive concept, on which a cover is mounted.
Figure 12:
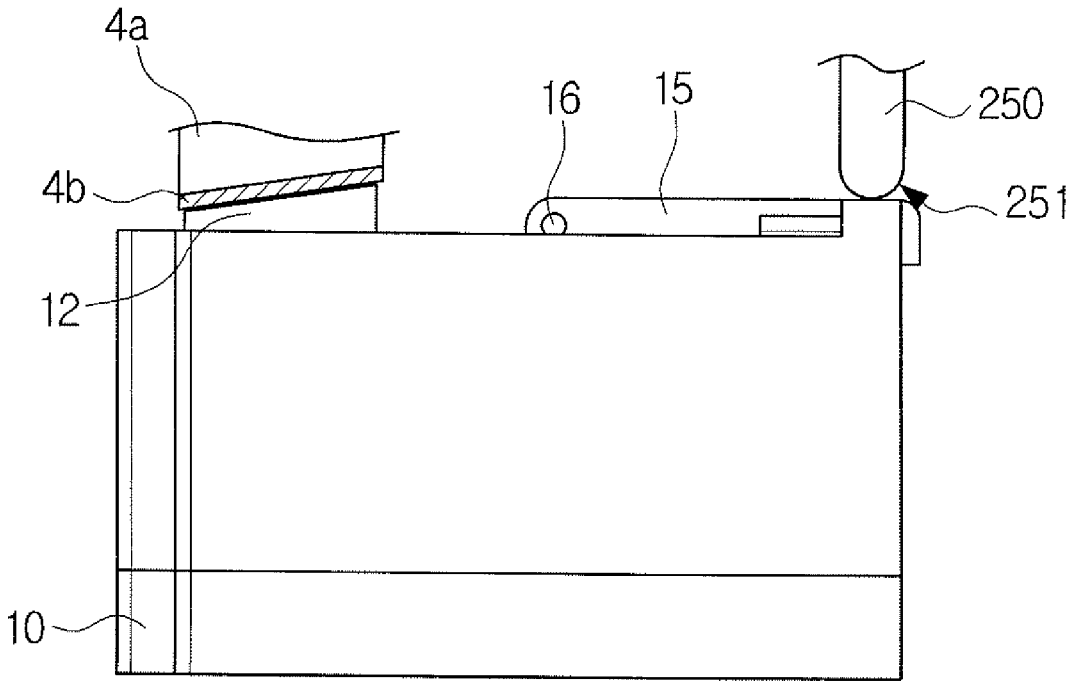
FIG. 12 illustrates the main portion of FIG. 11.

221*c*, the user is now able to release the cover 100 by rotating the first and second rotary handles 210 and 220 as illustrated in FIGS. 7A and 7B.

When the cover 100 is released, the transferring unit 3 and the developing unit 4 shielded by the cover 100 are exposed so that maintenance work, such as repair and replacement, can be performed.

To re-mount the cover 100, the above steps can be performed in reverse order. More specifically, after the transferring unit 3 and the developing unit 4 are completely mounted, the user can connect the cover 100 by rotating the first and second rotary handles 210 and 220 since the first and second restriction units 230 and 240 are not interfering with the first and second cam members 211 and 221 as illustrated in FIGS. 6A and 6B. In addition, the exterior cover can be structured not to be shut by interference with the grip parts 210*a* and 220*a* (FIG. 1) of the first and second rotary handles 210 and 220 when the user forgets to lock the cover 100 and tries to shut an exterior cover of the main body 1 of image forming apparatus. Thus, the exterior cover can be prevented from being shut without locking the cover 100.

Although the user mounted the cover 100 after fully mounting the transferring unit 3 and the developing unit 4, the user may sometimes mount the waste-developer receptacle 10 without locking the cover 100 by mistake. In this case, as sliding up along the guide slope 11 of the waste-developer receptacle 10, the sensing lever 250 moves the first and second restriction levers 231 and 241 respectively in arrowed directions C1 and C2 (FIGS. 8A and 8B) to hinder rotation of the first and second cam members 211 and 221. Since the first and second cam members 211 and 221 are in the released position, the first and second restriction pins 232 and 242 are contacted with the second and third cam profiles 215 and 221*b* and inserted into the first and second restriction levers 231 and 241.

However, since the second and third cam profiles 215 and 221*b* are gently curved, the first and second restriction pins 232 and 242 do not hinder rotation of the first and second cam members 211 and 221 although the user rotates the first and second cam members 211 and 221 using the first and second rotary handles 210 and 220. Therefore, the user is able to lock the cover 100 to the image forming apparatus without any hindrance simply by rotating the first and second rotary handles 210 and 220 in a direction to lock. When being rotated up to the locked position from the state of FIGS. 8A and 8B, the first and second rotary handles 210 and 220 are disposed as illustrated in FIGS. 5A and 5B.

The same operations apply to mount and remove the cover 100 with respect to the example in which the waste-developer receptacle 10 having the movable handle 15 is adopted. However, in this example, the movable handle 15 operates as the guide slope 11.

An image forming apparatus according to an embodiment of the present general inventive concept may include the main body 1 and the cover 100. The main body 1 may include the transferring unit 3, the developing unit 4, and the waste-developer receptacle 10 mounted therein. The cover 100 is mounted to the main body 1 to shield the transferring unit 3 and the developing unit 4. Here, the cover 100 is removably mounted by the cover opening and closing unit having the above structure.

According to an embodiment of the present general inventive concept, the cover 100 can be opened only after the waste-developer receptacle 10 is removed and therefore the connection structure between the drain 4*a* of the developing unit 4 and the waste-developer inlet 12 of the waste-developer receptacle 10 can be simplified. Consequently, leakage of developer during replacement of the developing unit 4 can be prevented.

Moreover, the user can observe the correct order to remove and mount the cover 100 during maintenance work more easily because removal and mounting of the cover 100 can be achieved only in the correct order.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A cover opening and closing unit for an image forming apparatus, comprising:

a cover removably mounted to a main body of the image forming apparatus, the main body mounting a developer cartridge, a developing unit, a transferring unit and a waste-developer receptacle therein; and a locking device to fix the cover to the main body of the image forming apparatus, wherein the locking device is released from the main body only after the waste-developer receptacle is removed from the main body.

2. The cover opening and closing unit of claim 1, wherein the cover is formed to shield the developing unit and the transferring unit, and is mounted to the main body of the image forming apparatus so that the developer cartridge and the waste-developer receptacle are exposed.

3. The cover opening and closing unit of claim 1, wherein the locking device comprises:

at least one rotary handle;

a locking member to protrude and withdraw in association with a rotation of the rotary handle, and being resiliently biased by a first resilient member disposed between the cam member and the locking member;

a cam member rotated in association rotation of the rotary handle to thereby protrude and withdraw the locking member;

a restriction unit to reciprocate between a first position to hinder rotation of the cam member and a second position released from the cam member; and a sensing lever displaced according to whether the waste-developer receptacle is mounted, and thereby to move the restriction unit to the first position when the waste-developer receptacle is removed.

4. The cover opening and closing unit of claim 3, wherein the restriction unit comprises:

a restriction lever to reciprocate between the first and second positions in association with the displacement of the sensing lever; and a restriction pin moveable to protrude and withdraw and mounted to one end of the restriction lever nearer to the cam member, and hooked in a fixing recess formed on the cam member when the restriction lever is in the first position.

5. The cover opening and closing unit of claim 4, wherein the sensing lever includes a sensing protrusion formed at one end thereof and interfered with an upper end of the waste-developer receptacle, the sensing protrusion has slant surfaces in directions to both mount and remove the waste-developer receptacle, and the restriction lever is mounted horizontally while the sensing lever is disposed vertically.

6. The cover opening and closing unit of claim 5, further comprising:

an intermediate member that reciprocates the restriction lever transversely according to up and down movement of the sensing lever, and wherein the intermediate member comprises, a first rack formed on the other end of the sensing level, a second rack formed on the other end of the restriction lever, and a pinion geared with the first and the second racks respectively.

7. The cover opening and closing unit of claim 6, further comprising:

a second resilient member to resiliently bias the restriction lever to the second position;

a third resilient member to resiliently bias the restriction pin outward with respect to the restriction lever; and a fourth resilient member to resiliently bias the sensing lever outward with respect to the cover.

8. The cover opening and closing unit of claim 7, wherein the waste-developer receptacle includes a guide part disposed to face the sensing lever and having a guide surface.

9. The cover opening and closing unit of claim 8, wherein the waste-developer receptacle includes a waste-developer inlet slantly formed and engaged with a drain to discharge waste developer from the developing unit, and the waste-developer inlet has a higher end in a direction to remove the waste-developer receptacle and a lower end in a direction to mount the waste-developer receptacle.

10. The cover opening and closing unit of claim 7, wherein the waste-developer receptacle comprises a moveable handle disposed on a position to face the sensing lever to fold and unfold by a hinging movement.

11. A cover opening and closing unit for an image forming apparatus, comprising:

a cover removably mounted to a main body of the image forming apparatus, the main body mounting a developer cartridge, a developing unit, a transferring unit and a waste-developer receptacle therein; and a locking device to fix the cover to the main body of the image forming apparatus, wherein the locking device is released from the main body only after the waste-developer receptacle is removed from the main body, and comprises first and second rotary handles to rotate between a locked position and a released position, first and second cam members to rotate in association with rotation of the first and second rotary handles, respectively;

first and second locking members to protrude and withdraw respectively by the first and second rotary handles;

first and second resilient members to resiliently bias the first and second locking members, respectively;

first and second restriction units to reciprocate between a first position to hinder rotation of the first and second cam members and a second position released from the cam members; and a sensing lever displaced according to whether the waste-developer receptacle is mounted, and thereby to move the restriction unit to the first position when the waste-developer receptacle is removed.

12. The cover opening and closing unit of claim 11, wherein the first cam member comprises:

a first cam profile to protrude and withdraw the first locking member; and a first gear part geared with a reset member to reset an initial position of the transferring unit.

13. The cover opening and closing unit of claim 12, wherein the reset member comprises:

a second gear part geared with the first gear part;

a second cam profile interfered with the first restriction unit; and a first fixing recess to hook the first restriction unit being in the first position.

14. The cover opening and closing unit of claim 13, wherein the second cam member comprises:

a third cam profile to protrude and withdraw the second locking member;

a fourth cam profile interfered with the second restriction unit; and a second fixing recess to hook the second restriction unit being in the first position.

15. The cover opening and closing unit of claim 14, wherein the first and second restriction units respectively comprise:

first and second restriction levers to reciprocate between the first position and the second position in association with the displacement of the sensing lever; and first and second restriction pins moveable to protrude and withdraw and formed at one end of the first and second restriction levers respectively, the one end nearer to the first and second cam members, and hooked in the first and second fixing recesses when the restriction levers are in the first position, and wherein the sensing lever comprises:

a sensing protrusion formed at one end thereof, interfered with the upper end of waste-developer receptacle, and having slant surfaces in directions to both mount and remove the waste-developer receptacle, and wherein the first and second restriction levers and the sensing lever include at least one sliding slot to be slidably engaged with the cover by a fixed pin and a washer passing the sliding slot.

16. The cover opening and closing unit of claim 15, further comprising:

first and second intermediate members that transversely reciprocate the first and second restriction levers, respectively, according to up and down movement of the sensing lever, the first and second intermediate members comprising, first and second racks formed on both sides of the other end of the sensing lever;

third and fourth racks formed on the other ends of the first and second restriction levers;

a first pinion geared with the first and third racks; and a second pinion geared with the second and fourth racks.

17. The cover opening and closing unit of claim 16, further comprising:

third and fourth resilient members to resiliently bias the first and second restriction levers respectively to the second position;

fifth and sixth resilient members to resiliently bias the first and second restriction pins outward with respect to the first and second restriction levers, respectively; and a seventh resilient member to resiliently bias the sensing lever outward with respect to the cover.

18. An image forming apparatus comprising:

a main body in which a developing unit, a transferring unit, and a waste-developer receptacle are mounted; and a cover opening and closing unit removably mounted to the main body to shield the developing unit and the transferring unit, wherein the cover opening and closing unit comprises:

a cover removably mounted to a main body of the image forming apparatus, the main body mounting a developer cartridge, a developing unit, a transferring unit and a waste-developer receptacle therein;

a locking device to fix the cover to the main body of the image forming apparatus, wherein the locking device is released from the main body only after the waste-developer receptacle is removed from the main body, and comprises:

first and second rotary handles to rotate between a locked position and a released position;

first and second cam members to rotate in association with rotation of the first and second rotary handles, respectively;

first and second locking members to protrude and withdraw respectively by the first and second rotary handles;

first and second resilient members to resiliently bias the first and second locking members, respectively;

first and second restriction units to reciprocate between a first position to hinder rotation of the first and second cam members and a second position released from the cam members; and a sensing lever displaced according to whether the waste-developer receptacle is mounted, and thereby to move the restriction unit to the first position when the waste-developer receptacle is removed.

19. A method of removing a cover of an image forming apparatus, comprising:

removing a waste-developer receptacle;

moving a sensing lever down by interference with the waste-developer receptacle;

moving first and second restriction levers by downward movement of the sensing lever to separate from the first and second cam members; and releasing the cover by rotating first and second rotary handles.

20. A removable cover of an image forming apparatus that mounts therein a developer cartridge, a developing unit, a transferring unit and a waste-developer receptacle therein, the removable cover comprising:

a cover plate having a plurality of locking members to lock the cover plate to the image forming apparatus in a position to shield the developing unit and the transferring unit from access while allowing access to the developer cartridge and the waste-developer;

a plurality of rotary handles to protrude and withdraw the plurality of locking members to lock the cover plate; and a sensing lever mounted on the cover plate to prevent the locking of the cover plate when the waste-receptacle is not mounted.

21. The removable cover of claim 20, further comprising:

a plurality of cam members to rotate according to a rotation of a corresponding one of the plurality of rotary handles to protrude and withdraw the locking member; and a plurality of restriction units to reciprocate between a first position to prevent rotation of a corresponding one of the plurality of cam members and a second position to release the corresponding one of the plurality of cam members, wherein the sensing lever moves the restriction units to the first position when the waste-developer receptacle is removed.

22. The removable cover of claim 20, wherein the removable cover cannot be removed without first removing the waste-developer receptacle.

23. A removable cover of an image forming apparatus that mounts a plurality of image forming units in a main body thereof, the removable cover comprising:

a removable cover plate to shield a predetermined number of the image forming units in the main body while allowing access to another predetermined number of image forming units in the main body;

a plurality of locking members to lock the removable cover plate to the image forming apparatus;

a plurality of rotary handles to move the locking members to one of a lock position and an unlock position; and a sensing lever to prevent the locking of the removable cover plate according to an absence of one of the another predetermined number of image forming units.

24. The removable cover of claim 23, wherein the another predetermined number of image forming units comprises at least one of a developer cartridge and a waste-developer receptacle.

25. The removable cover of claim 23, wherein the removable cover plate cannot be removed without first removing the one of the another predetermined number of image forming units.

* * * * *